US008376144B2

(12) United States Patent
Yokokawa et al.

(10) Patent No.: US 8,376,144 B2
(45) Date of Patent: Feb. 19, 2013

(54) MEDIA SEPARATOR AND METHOD

(75) Inventors: Hiroshi Yokokawa, Gunma (JP); Takashi Okada, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/003,395

(22) PCT Filed: Jun. 18, 2009

(86) PCT No.: PCT/JP2009/061093

§ 371 (c)(1),
(2), (4) Date: Jan. 10, 2011

(87) PCT Pub. No.: WO2010/004842

PCT Pub. Date: Jan. 14, 2010

(65) Prior Publication Data

US 2011/0163493 A1 Jul. 7, 2011

(30) Foreign Application Priority Data

Jul. 10, 2008 (JP) ..... 2008-180100

(51) Int. Cl.
*B65H 1/00* (2006.01)

(52) U.S. Cl. ..... 209/534; 271/3.18; 271/3.14; 271/4.01

(58) Field of Classification Search ..... 271/126, 271/3.14, 4.01, 3.03, 3.18, 3.01; 209/534
See application file for complete search history.

(56) References Cited

U.S. PATENT DOCUMENTS

| | | | | |
|---|---|---|---|---|
| 4,697,071 | A * | 9/1987 | Hiraoka et al. | 235/379 |
| 6,290,070 | B1 * | 9/2001 | Graef et al. | 209/534 |
| 7,404,552 | B2 * | 7/2008 | Abe et al. | 271/3.14 |
| 7,422,118 | B2 * | 9/2008 | Ugo et al. | 209/534 |
| 2002/0011431 | A1 * | 1/2002 | Graef et al. | 209/534 |
| 2003/0094402 | A1 * | 5/2003 | Seo et al. | 209/534 |
| 2003/0196936 | A1 * | 10/2003 | Graef et al. | 209/534 |
| 2007/0000822 | A1 * | 1/2007 | Yoshioka | 209/534 |

FOREIGN PATENT DOCUMENTS

| | | | |
|---|---|---|---|
| JP | 59-077589 | A | 5/1984 |
| JP | 2004-155539 | A | 6/2004 |
| JP | 2004-210505 | A | 7/2004 |

* cited by examiner

*Primary Examiner* — Kaitlin Joerger
(74) *Attorney, Agent, or Firm* — Rabin & Berdo, P.C.

(57) ABSTRACT

To provide a media separator including a lumped-media conveyer mechanism which receives lumped media to convey the lumped media in a predetermined direction, and a picker roller which separates the lumped media conveyed by the lumped-media conveyer mechanism, the lumped-media conveyer mechanism including an auxiliary conveyer body for conveying the lumped media to the picker roller. That makes it possible to reliably separate and send out the lumped media, when having shorter media mixed, and to achieve downsizing of the media separator.

18 Claims, 8 Drawing Sheets

MEDIA SEPARATOR AND METHOD

TECHNICAL FIELD

The present invention relates to a media separator and a method for separating media in lump, and, in more particular, to a paper sheet separator and a method for separating paper sheets or the like, such as bills, put in a lump into the separator from each other prior to sending them out to the outside of the separator.

BACKGROUND ART

Conventionally, media separators for separating paper sheet-like media inserted in a lump from each other to send them out have been used in, for example, bill teller machines and the like.

In such a media separator, when paper sheets different in length are inserted in a lump at one time without aligning the leading edges thereof in the insertion direction, shorter paper sheets remain inside the media separator. Thus, there has been a problem that it is impossible to convey remaining media to a conveyer or the like disposed at the subsequent stage of the media separator.

As a device for solving that problem, there is a media separator described in Japanese patent laid-open publication No. 2002-155539. This separator has an auxiliary picker roller disposed between a lumped-media conveyer mechanism and a picker roller to rotate to thereby send out shorter media received by the lumped-media conveyer mechanism toward the picker roller. That makes it possible to convey media, even shorter, to a conveyer or the like disposed downstream the media separator without having shorter media remain within the lumped-media conveyer mechanism.

However, in the above-mentioned separator, it is very difficult to additionally dispose an auxiliary picker roller in an extremely small space from the media inlet slot to the picker roller. Therefore, there is a problem that the separator would be structurally overstuffed so as to possibly cause a conveyance difficulty such as a paper jam.

SUMMARY OF THE INVENTION

Considering the above problems, it is an object of the present invention to provide a media separator and a method for reliably separating lumped media which may be different in length to send out them without causing any conveyance difficulty.

In accordance with the present invention, a media separator for separating and sending out lumped media includes a lumped-media conveyer mechanism which receives lumped media to convey the lumped media in a predetermined direction, and a picker roller which separates the lumped media conveyed by the lumped-media conveyer mechanism. The lumped-media conveyer mechanism has an auxiliary conveyer body for conveying the media to the picker roller.

Furthermore, in accordance with the present invention, a media separating method for separating and sending out lumped media includes using a lumped-media conveyer mechanism which conveys lumped media received from the outside in a predetermined direction to convey the lumped media in the predetermined direction, using a picker roller to separate the conveyed lumped media, and conveying a medium relatively so short as not to reach the picker roller to the picker roller by means of an auxiliary conveyer body arranged in the lumped-media conveyer mechanism.

In accordance with the present invention, even when lumped media which have paper sheet-like media different in length mixed are input in a lump and a shorter medium does not reach the picker roller, the medium is conveyed toward the picker roller by the auxiliary conveyer body arranged in the lumped-media conveyer mechanism. It is therefore possible to reliably separate media from the lumped media, regardless of the length of each medium, to convey separated media.

Further, in accordance with the present invention, since the auxiliary conveyer body is arranged in the lumped-media conveyer mechanism, it is possible to establish a media conveyance channel from a site receiving the media to the picker roller, which can expect a secure conveyance and achieve downsizing of the media separator.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

Figure 1:
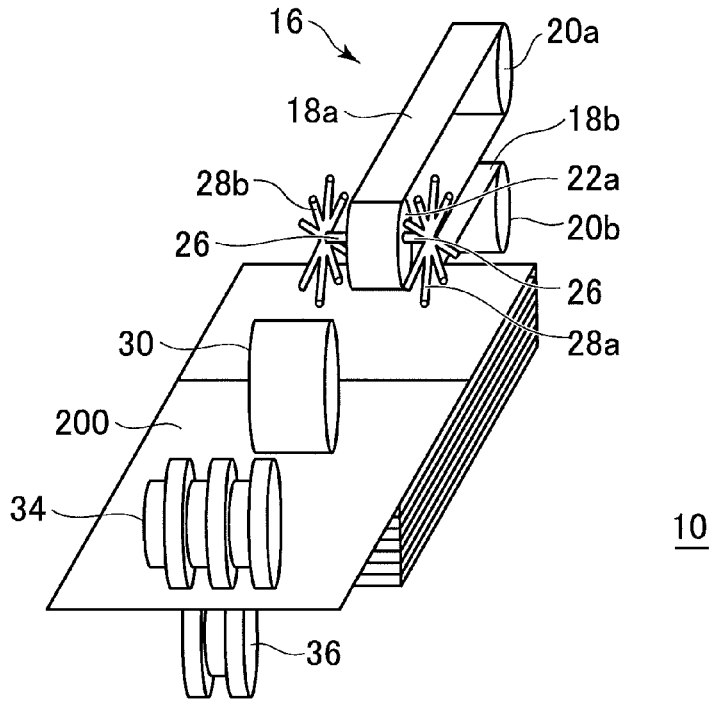
FIG. 1 is an essential perspective view schematically showing an embodiment of a media separator according to the present invention.

Next, an embodiment of a media separator according to the present invention will be described in detail with reference to the accompanying drawings. A media separator 10 according to the present embodiment shown in FIG. 1 is for use in, for example, a bill teller machine 100 shown in FIG. 2. Therefore, for convenience of describing the present embodiment in the following, it is assumed that paper sheet-like media are bills.

However, the media separator according to the present invention separates media in a lump from each other, which are not limited to bills but may be any kinds of paper sheets such as checks and various types of cards. Therefore, the media separator 10 according to the present invention is applicable to not only the bill teller machine 100 shown in FIG. 2 but also various paper sheet processors.

Figure 2:
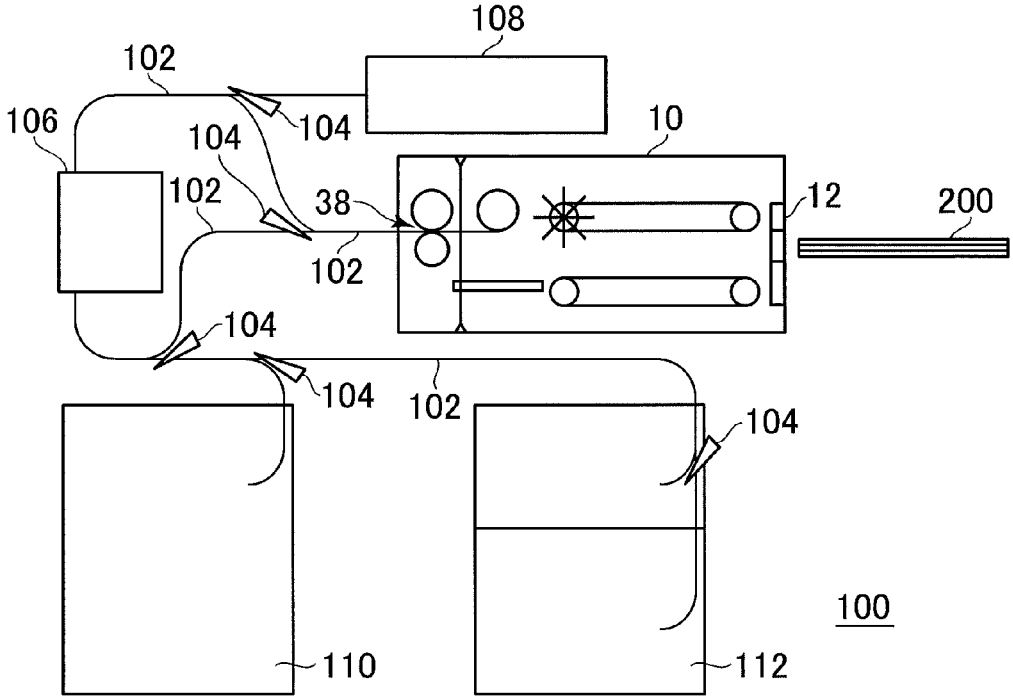
FIG. 2 is a schematic explanatory diagram showing an example of bill teller machine using the media separator shown in FIG. 1.

First, the configuration and operation of the bill teller machine 100 in which the media separator 10 according to the present invention is for use will be schematically described with reference to FIG. 2.

Inside the bill teller machine 100, the media separator 10 according to the present invention is disposed so as to be capable of receiving bills 200 in a lump. For example, the media separator 10 is provided with a customer interface 12 serving as receiving the bills 200 from the outside of the bill teller machine 100 so that the customer interface 12 functions as an inlet of the bill teller machine 100. The media separator 10, when having received the bills 200 in a lump through the customer interface 12, separates the bills 200 from each other in the processes which will be described later in detail.

The media separator 10 has a bill discharger unit (separator gate 38, which will be described later) for discharging separated bills. The bill discharger unit is connected to a bill conveyance channel 102. The bill conveyance channel 102 is branched off at several points, each of which is provided with a blade 104 for switching bills to a desired conveying direction. The bill conveyance channel 102 serves as a path for feeding a bill sent out from the media separator 10 into another processing section such as a discriminator 106 which will be described later.

The separator gate 38 of the media separator 10 is connected through the bill conveyance channel 102 to the bill receiving slot of the discriminator 106. The discriminator 106 receives bills individually sent out from the media separator 10 on its bill receiving slot, and discriminates the received bills in denomination, damaged or not, authenticity, number of sheets or the like.

The separator gate 38 of the media separator 10 and a bill discharging slot of the discriminator 106 may be configured to be connected to the bill receiving slot of a temporary storage 108 through the bill conveyance channel 102. The temporary storage 108 receives any bills from the bill receiving slot and holds them as bills sent out from the media separator 10 or judged as abnormal by the discriminator 106 in accordance with an intended use of the bill teller machine 100.

Moreover, the separator gate 38 in the media separator 10 and the bill discharging slot of the discriminator 106 are connected through the bill conveyance channel 102 to bill storages 110 and 112. The bill storages 110 and 112 are units for ultimately storing bills therein, which can be sorted out, for example, in terms of denomination by switching the blades 104.

Next, the configuration of the embodiment of the media separator 10 according to the present invention will be described with reference to FIGS. 1 and 3. In addition, for convenience of understanding the invention, some components may daringly be omitted from FIGS. 1 and 3.

The media separator 10 has the customer interface 12. This customer interface specifically has a bill inlet slot 14 into which the bills 200 are input by the input action of a user, the operation of another device or the like. The bill inlet slot 14 may be provided with a shutter, which is configured to open to allow the bills 200 to be accepted only when bills 200 are to be separated.

The media separator 10 has a lumped-media conveyer mechanism 16 for conveying the lumped bills 200. As for the layout of the customer interface 12, the lumped-media conveyer mechanism 16 is disposed to be connected to the customer interface 12 so as to be capable of receiving the lumped bills 200 from the outside through the bill inlet slot 14 of the customer interface 12. That means that the media conveying mechanism 16 has its conveying source end connected to the customer interface 12. This configuration allows the customer interface 12 to function to guide lumped media inserted from the outside to the media conveying mechanism 16.

The lumped-media conveyer mechanism 16 is composed of an upper and a lower conveyor 16*a* and 16*b* respectively disposed above and under the inserted bills 200. The upper and lower conveyors 16*a* and 16*b* have respective endless belts 18*a* and 18*b* for conveying the bills 200. Furthermore, the upper and lower conveyors 16*a* and 16*b* have respective pulleys 20*a* and 20*b* disposed at the ends thereof on the side of the customer interface 12, more specifically, of the conveying source of the bills 200, as well as respective pulleys 22*a* and 22*b* disposed at the ends thereof in the reverse direction, more specifically, on the side of the conveying destination of the bills 200.

The endless belt 18*a* bridges the pulleys 20*a* and 22*a*. Similarly, the endless belt 18*b* bridges the pulleys 20*b* and 22*b*. The endless belts 18*a* and 18*b*, thus bridging, are kept in the horizontal direction. The space between the endless belts 18*a* and 18*b* serves as a conveying channel for the bills 200 inside the lumped-media conveyer mechanism 16.

Furthermore, the media separator 10 may be provided with sensors 24 monitoring the vicinity of the connecting portion on the side of the slot 12 of the lumped-media conveyer mechanism 16 to sense the bills 200 being input. In the present embodiment shown in the figures, the sensors 24 are disposed in the vicinity of the customer interface 12 one above the other with respect to the lumped-media conveyer mechanism 16 so as to face each other. However, the sensors 24 may be disposed at any positions as long as they can sense the bills 200 being input.

Figure 3:
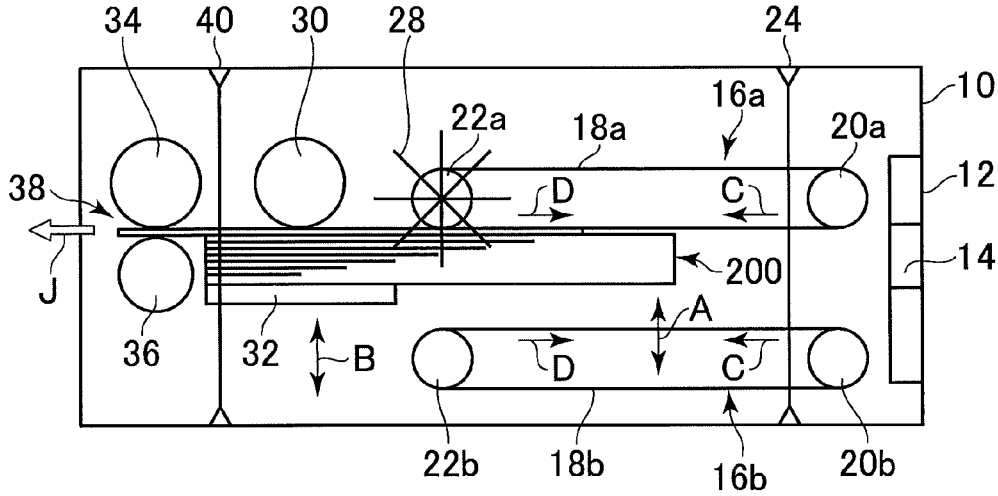
FIG. 3 is a schematic essential side view of the embodiment shown in FIG. 1.

The lower conveyor 16*b* is connected to a driving unit, not shown, and is movable in the vertical direction, arrow A in FIG. 3, in response to the power generated by and transmitted from the driving unit. The lower conveyor 16*b* vertically shifts upward in response to the inserted bills being sensed by the sensors 24 to allow the inserted bills 200 to be pinched between the upper and lower conveyors 16*a* and 16*b*. Further, the lower conveyor 16*b* vertically shifts downward to allow the pinched bills 200 to be released from the lumped-media conveyer mechanism 16.

At least one of the pulleys 20*a* and 22*a* and at least one of the pulleys 20*b* and 22*b* are connected to the driving unit, not shown, to receive the power generated by and transmitted from the driving unit, not shown, to be rotated in predetermined directions. By rotating the pulleys 20*a* and 22*a* in the same direction and by rotating the pulleys 20*b* and 22*b* in the reverse direction to the pulleys 20*a* and 22*a*, the endless belts 18 are brought into action in the horizontal direction. By this action, it is possible to convey the bills 200, inserted from the bill inlet slot 14 and pinched by the operation of the lower conveyor 16*b*, to the subsequent mechanism, arrows C in FIG. 3. Further, in case of unforeseeable circumstances, the respective pulleys may be rotated in the directions opposite to the normal conveyance operation to thereby convey the bills 200 toward the bill inlet slot 14 to be returned, arrows D in FIG. 3.

The pulley 22*a* on the side of the conveying direction of the upper conveyor 16*a* has a shaft hole passing through its central part, into which a shaft 26 is inserted to be fixed to the pulley. Moreover, the shaft 26 inserted into the pulley 22*a* has both ends thereof provided with tongue pieces 28*a* and 28*b* serving as auxiliary conveying bodies. Since that configuration renders the tongue pieces 28 to be arranged coaxially with the pulley 22, the rotation of the pulley 22*a* causes the tongue pieces 28 to rotate as well.

The tongue pieces 28 are configured to include the tongue pieces 28*a* and 28*b* attached to the respective ends of the shaft 26. The tongue pieces 28*a* and 28*b* are constituted of plate-like bodies made of elastic material such as rubber or synthetic resin radially provided. The rotary movement of the tongue pieces 28 which have the plate-like bodies radially provided causes bills whose length is not enough to reach a picker roller, which will be described later, to be fed out toward the picker roller. Since the tongue pieces 28 are formed of elastic bodies made of soft material easily deformable with external force, the bills 200 being conveyed would not receive great load.

On the side of the separator gate 38, more specifically at a position facing the pulley 22*a* in the bill conveying direction, of the lumped-media conveyer mechanism 16, a picker roller 30 connected to the driving unit, not shown, is disposed. Due to this layout, the picker roller 30 receives the bills conveyed from the lumped-media conveyer mechanism 16. The picker roller 30 receives the power transmitted from the driving unit to rotate, thereby individually feeding out the bills 200 conveyed from the lumped-media conveyer mechanism 16.

Under and opposite to the picker roller 30 in the vertical direction, disposed is a press 32 for pressing the bills 200 against the picker roller 30. The press 32 is movable up and down, arrow B, by the driving unit not shown, thereby allowing the bills 200 to be pressed against and released from the picker roller 30. The operation of the press 32 may be executed in response to the bills 200 being sensed by the sensors installed in places.

Facing the picker roller 30 in the conveying direction of the bills 200, a feed roller 34 is disposed which is connected to the driving unit, not shown. Moreover, under and opposite to the feed roller 34, a reverse roller 36 is disposed. The reverse roller 36 as well may be connected to the driving unit, not shown. The rotary movement of the feed roller 34 and the reverse roller 36 causes the bills 200 conveyed from the picker roller 30 to be separated from each other to be transferred to the subsequent stage. That is, the feed roller 34 and the reverse roller 36 compose a bill discharger unit, i.e. the separator gate 38.

In the present embodiment, as shown in FIG. 3, sensors 40 for detecting the conveyed bills 200, i.e. gate sensors 40 may be disposed between the separator gate unit 38 and the picker roller 30. With the instant embodiment, the sensors 40 are disposed in the vertical direction on the side of the picker roller 30 with respect to the separator gate unit 38 so as to face each other. Preferably, the lumped-media conveyer mechanism 16 and the press 32 may operatively be connected to the sensors 40 so that, whenever the sensors 40 sense the bills 200 being conveyed to the vicinity of the separator gate unit 38, the conveyance of the bills 200 by the lumped-media conveyer mechanism 16 will be ceased and the upward movement of the press 32 and the downward movement of the lower conveyor 16*b* will be performed.

The bills 200 separated from each other pass between the feed roller 34 and the reverse roller 36 to be fed out to the outside of the media separator 10 as shown by an arrow J.

Figure 4:
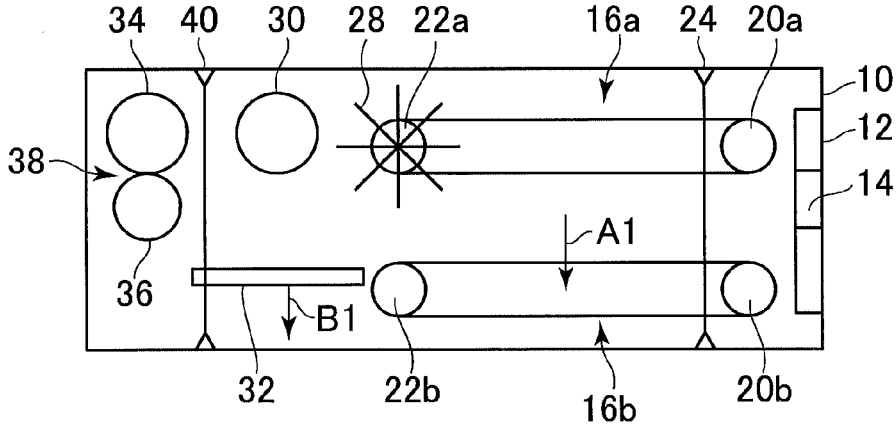
FIGS. 4 through 10 are essential side views for illustrating the operation of the embodiment shown in FIG. 1.

Now, the operation of the media separator 10 according to the above-described configuration will be described with reference to FIGS. 4 to 10. FIG. 4 shows the state of waiting for insertion of the bills 200. In this state, the lower conveyor 16*b* takes the state of being lowered as shown by an arrow A1, and the press 32 as well is lowered similarly as shown by an arrow B1.

Figure 5:
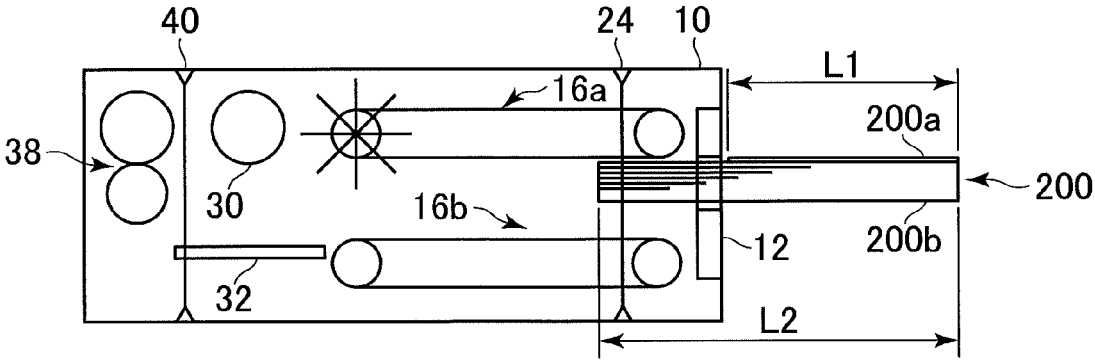

As shown in FIG. 5, through the customer interface 12, the bills 200 are sent into the lumped-media conveyer mechanism 16 of the media separator 10. At this time, it is assumed that two types of bills 200*a* and 200*b* different in length are mixed in the lumped bills 200. Given that the longitudinal lengths of the bills 200*a* and 200*b* are L1 and L2, respectively, it is assumed as L1<L2. Moreover, as shown in FIG. 5, it is assumed that the lumped bills 200 including the bills 200*a* and 200*b* have the rear edges thereof, in the conveying direction of the bills 200, aligned.

Figure 6:
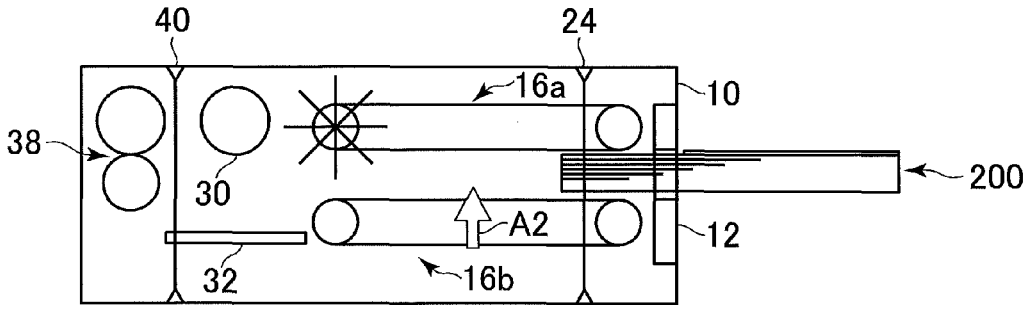

When the sensors 24 sense the bills being put in, as shown in FIG. 6, the lower conveyor 16*b* is moved upward as shown by an arrow A2 by the driving unit, not shown, and the bills 200 including the bills 200*a* and 200*b* are pinched between the upper and lower conveyers 16*a* and 16*b*.

Figure 7:
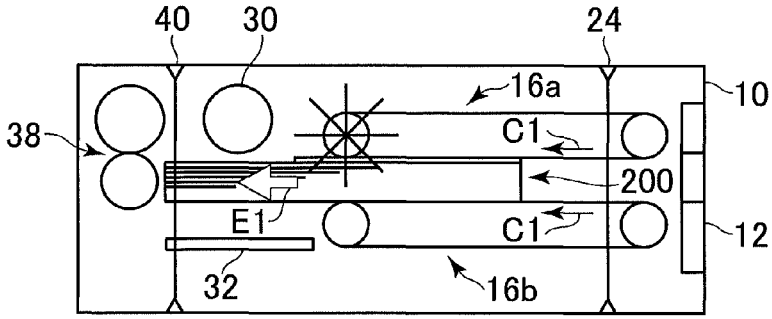

Next, as shown in FIG. 7, the pulleys 20 and 22 are rotate by the driving unit, not shown, and the endless belts 18 mounted on the lumped-media conveyer mechanism 16 are in turn operated such that the bills 200 are conveyed in a direction C1 in the figure, more specifically, in a direction toward the separator gate 38. This operation of the endless belts 18 causes the bills 200 are conveyed in a lump in a direction E1 in the figure.

When the sensors 40 sense the bills 200 arriving at the vicinity short of the separator gate 38, the driving unit ceases from operating after a predetermined period of time having elapsed. In turn, the pulleys 20 and 22 and hence the endless belts 18 will terminate the operation thereof after a predetermined period of time having elapsed. More specifically, upon detecting the arrival of the bills by the sensors 40, the bills 200 are conveyed by a predetermined distance, and thereafter the bills 200 will be stopped short of the separator gate 38, which includes the feed roller 34 and the reverse roller 36.

Figure 8:
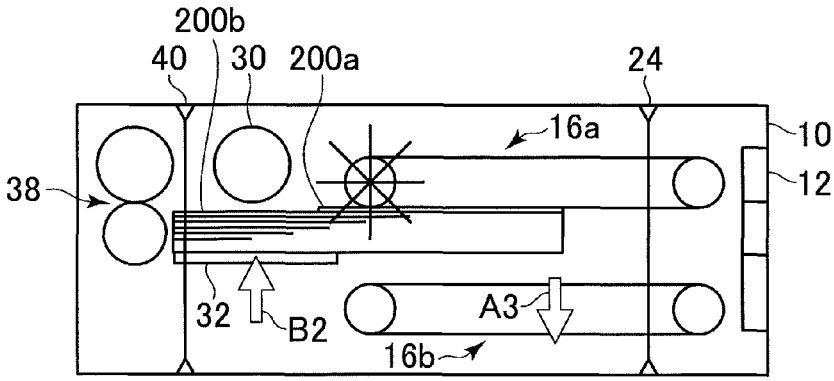

Subsequently, as shown in FIG. 8, the press 32 is shifted upward as depicted with an arrow B2 by the driving unit, not shown, to press the bills 200 against the picker roller 30 side. Further, the lower conveyor 16*b* is driven downward as shown with an arrow A3 by the driving unit, not shown. The lower conveyor 16*b* being driven downward causes the bills 200 to be released from being pinched by the lumped-media conveyer mechanism 16. At this time, the bills 200*b* are pressed against the picker roller 30 by the press 32, whereas the bills 200*a* have not been conveyed in position to the picker roller 30 so that the bills 200*a* do not touch the picker roller 30. The bills 200*a* would not come down when the lower conveyor 16*b* moves downward because the bills 200*b* lumped under the bills 200*a* are firmly pressed between the picker roller 30 and the press 32.

In this state, since the bills 200*b* under the bills 200*a* are pressed by the press 32 to touch the picker roller 30, one or some of the bills 200*b* will be fed out before the bills 200*a* are fed out in the operation described below. However, the order of feeding-out does not matter in the present invention, which would not bring about any disadvantage.

Figure 9:
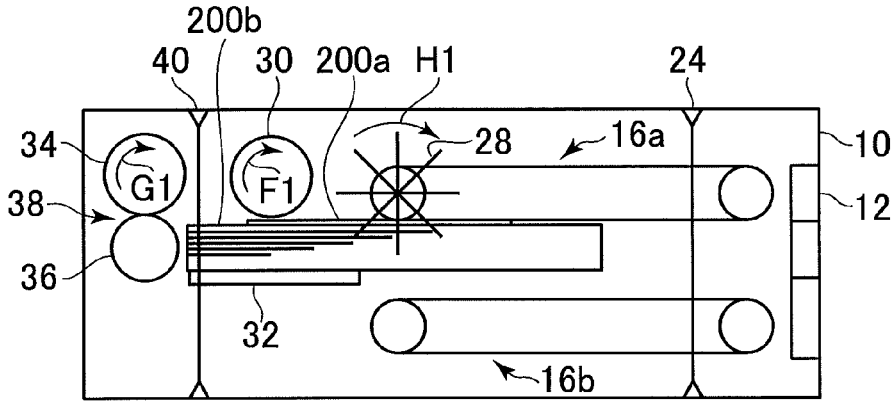

Next, as shown in FIG. 9, the driving unit, not shown, rotates the picker roller 30, the feed roller 34 and the tongue pieces 28 in the respective, same directions. FIG. 9 is drawn so that those are rotated clockwise, that is, the picker roller 30, the feed roller 34 and the tongue pieces 28 are rotated in the directions F1, G1 and H1, respectively. While the tongue pieces 28 rotate which are radially provided as plate-like bodies made of elastic material, the bills 200*a*, which have the length L1 and are on the top of the bills 200, are fed out toward the picker roller 30.

Figure 10:
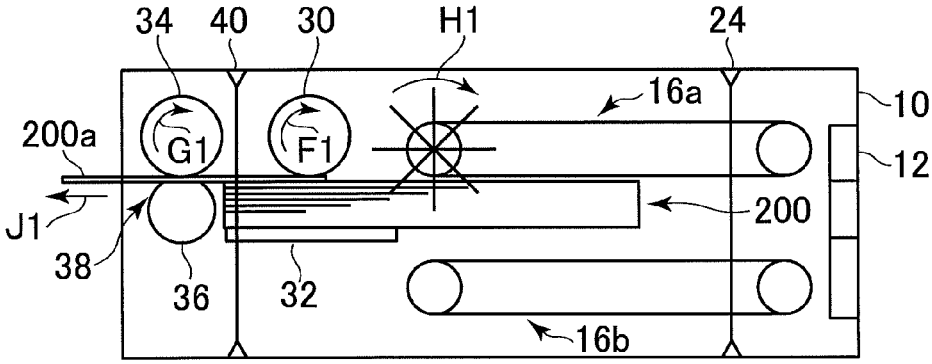

Once the bills 200*a* are conveyed to the picker roller 30, they receive the power generated by the picker roller 30 rotating to further be conveyed to the separator gate 38. Then, as shown in FIG. 10, the bills 200*a* pass between the feed roller 34 and the reverse roller 36 to be conveyed one by one in the direction of an arrow J1.

It is to be noted that, where all the lumped bills 200 are the same in length in the longitudinal direction thereof, the media separator 10 also operates in a similar fashion as described above and shown in FIGS. 4 to 10. In that case, all the bills are conveyed to the picker roller 30 without requiring auxiliary conveyance by the tongue pieces 28. Then, the bills are directly conveyed to the separator gate 38 to be fed out one by one. When the bills are fed out separately from each other from the separator gate 38 and the remaining bills are pressed against the picker roller 30 by the press 32 in the vicinity of the separator gate, the tongue pieces 28 will idle above the stopped bills. This operation is also the case with where the bills 200*a* and 200*b* have the edges thereof aligned in the conveying direction of the bills 200, that is, where the bills are inserted with the edges thereof aligned on the side facing the bill inlet slot 14.

As described above, in accordance with the present embodiment, even when the lumped bills 200 including the bills 200*a* and 200*b* different in length are put into the media separator 10 without aligning the leading edges thereof in the longitudinal direction, it is possible for the tongue pieces 28 to convey the shorter bills 200*a* which have not reached the picker roller 24 when the bills 200 are stopped to be conveyed short of the separator gate up to the picker roller 24. As with the longer bills 200*b*, the shorter bills 200*a* can be separated from the lumped bills 200 to be fed to the subsequent device.

Meanwhile, in the case where the bills 200 including ones different in length are put in a lump into the media separator 10 without aligning the front leading edges in the conveying direction of the bills 200, it is possible that, when the bills 200 are stopped to be conveyed inside the lumped-media conveyer mechanism 16, the bills 200*c* shorter in longitudinal length not enough to be conveyed to the auxiliary conveying bodies remain in the lumped-media conveyer mechanism 16. An alternative embodiment of the media separator 10 according to the present invention which will be described below is configured to overcome the case where the bills 200*c* remain in the lumped-media conveyer mechanism 16.

Some of the components of the media separator 10 of the alternative embodiment which are the same as the above-described embodiment will be denoted with the same reference numerals, and will not be described in detail. Further, for convenience of understanding the invention, some of the components may daringly be omitted from illustration.

Figure 11:
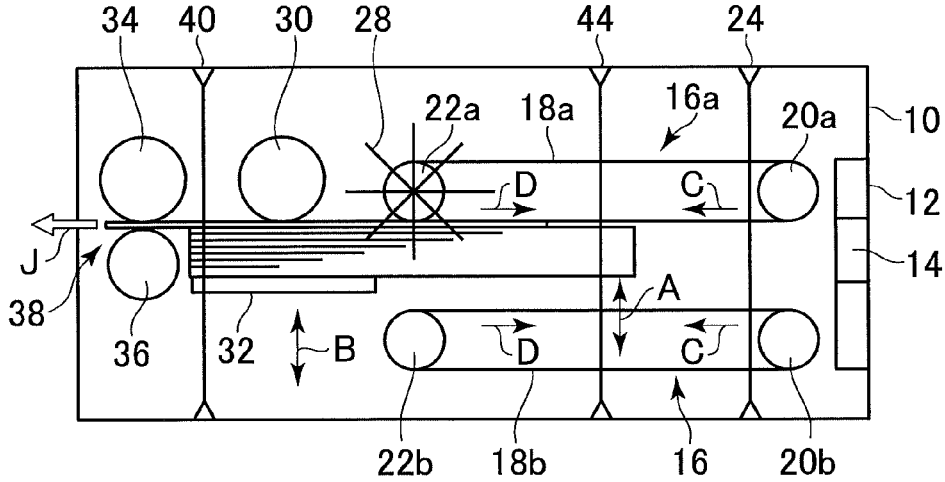
FIG. 11 is an essential side view schematically showing an alternative embodiment of the media separator according to the present invention.

In the alternative embodiment, as shown in an essential side view of FIG. 11, remaining-media sensors 44 are installed in addition to the configuration of the embodiment shown in FIG. 3. The remaining-media sensors 44 are disposed, for example, above and under the lumped-media conveyer mechanism 16 so as to face each other to thereby monitor the conveying channel for the bills 200 which forms a space between the upper and lower conveyors 16*a* and 16*b*. It thereby detects the bills 200*c* which are not fed out by the tongue pieces 28 or the picker roller 30 to remain on the way in the lumped-media conveyer mechanism 16. In FIG. 11, the sensors 44 are disposed above and under the lumped-media conveyer mechanism 16 substantially in the middle so as to face each other. However, they may be installed at any places as long as they can sense the bills 200 remaining in the mechanism 16. Further, it is preferable to operatively connect the sensors 44 to the media conveying mechanism 16 and the press 32 so that the lower conveyor 16*b* and the press 32 are brought into vertical movement in response to the sensors 44 having sensed a bill remaining.

Since the remaining components are the same in configuration as the above-described embodiment, a detailed description thereof will be omitted with the same components denoted with the same reference numerals.

Now, the operation of the alternative embodiment having the sensors 44 will be described with reference to FIGS. 12 to 19. Note that the same operation as the above-described embodiment may be appropriately omitted in order to avoid redundant description.

While waiting for insertion of the bills 200, the media separator 10 is the same as the earlier-described embodiment, in particular, FIG. 4, in the state where the lower conveyor 16*b* and the press 32 are both shifted downward.

Figure 12:
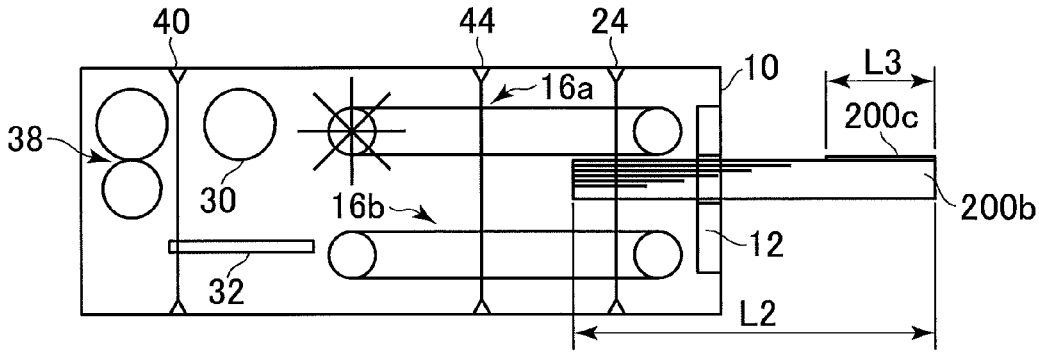
FIGS. 12 through 19 are essential side views for illustrating the operation of the embodiment shown in FIG. 11.

As shown in FIG. 12, through the bill inlet slot 14 of the customer interface 12, the bills 200 are sent into the lumped-media conveyer mechanism 16. At this time, it is assumed that two types of bills 200*b* and 200*c* different in length are mixed in the lumped bills 200 and that the lumped bills 200 including the bills 200*b* and 200*c* have the rear edges thereof, in the conveying direction of the bills 200, aligned. That is, it is assumed that the bills are inserted with the edges thereof, opposite to the edges aligned, oriented toward the bill inlet slot 14.

Given that the longitudinal lengths of the bills 200*b* and 200*c* are L2 and L3, respectively, it is assumed as L2>L3. It is further assumed that the longitudinal length L3 of the bills 200*c* is yet shorter than the longitudinal length L1 of the bills 200*a* for use in the earlier-described embodiment to the extent that, when the bills are put into the media separator 10 with the rear edges, in the conveying direction, of the bills 200 aligned, and then the front edges of the bills 200*b* reach the separator gate 38, the bills 200*c* are so short as not to reach the picker roller 30 as well as even the tongue pieces 28.

When the sensors 24 sense the bills 200 being inserted, as with the earlier-described embodiment shown in FIG. 6, the lower conveyor 16*b* is moved upward as shown by the arrow A2 by the driving unit, not shown, and the bills 200 including the bills 200*b* and 200*c* are pinched between the upper conveyor 16*a* and the lower conveyor 16*b*.

Figure 13:
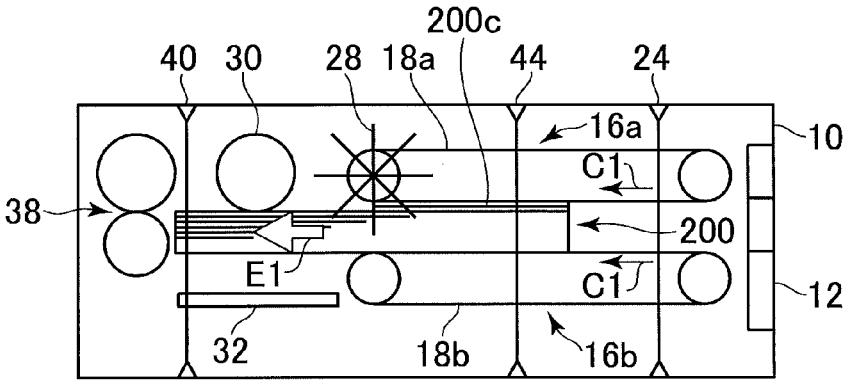

Next, the driving unit, not shown, rotates the pulleys 20 and 22, and the endless belts 18 mounted on the lumped-media conveyer mechanism 16 are thereby moved in the direction C1 in the figure. That operation of the endless belts 18 makes the bills 200 are conveyed in a lump in the direction E1 in the figure. When the sensors 40 senses the bills 200 arriving at the vicinity short of the separator gate 38, the operation of the driving unit is stopped after the predetermined period of time having elapsed. That will cause the operation of the pulleys 20 and 22 and hence the endless belts 18 to be terminated after the predetermined period of time having elapsed. More specifically, upon the sensors 40 detecting the arrival of the bills, the bills 200 are conveyed by the predetermined distance and then stopped prior to the separator gate 38. This operation is in the same way as the earlier-described embodiment. However, with the alternative embodiment, the shorter bills 200*c* have not reached the tongue pieces 28 as shown in FIG. 13.

Subsequently, the driving unit, not shown, moves the press 32 upward to press the bills 200 against the picker roller 30. Further, the driving unit, not shown, drives the lower conveyor 16*b* downward. The bills 200 are thereby released from being pinched by the lumped-media conveyer mechanism 16. This operation is the same as in the earlier-described embodiment shown in FIG. 8. However, at this time, despite that the bills 200*b* are pressed against the picker roller 30 by the press 32, the bills 200*c* have not reached the picker roller 30 and the tongue pieces 28 due to their shorter length.

Figure 14:
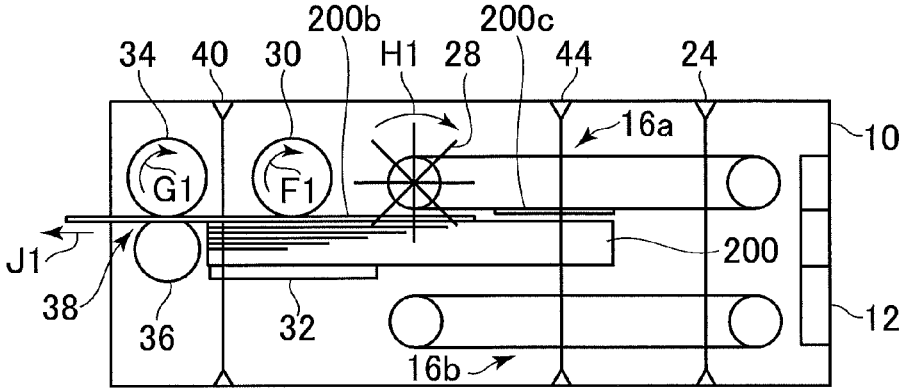

Next, as shown in FIG. 14, the driving unit, not shown, rotates the picker roller 30, the feed roller 34 and the tongue pieces 28 in the respective, same directions. FIG. 14 is drawn such that those are rotated clockwise, that is, the picker roller 30, the feed roller 34 and the tongue pieces 28 are rotated in the directions F1, G1 and H1, respectively. While the tongue pieces 28 and the picker roller 30 rotate, the bills 200*b* whose length is L2 are fed out to be conveyed one by one to the separator gate unit 38 to individually pass between the feed roller 34 and the reverse roller 36 in series to be sent out from the media separator 10. By contrast, the bills 200*c* whose length is L3 are not sent out to the outside, but remain in the lumped-media conveyer mechanism 16.

Figure 15:
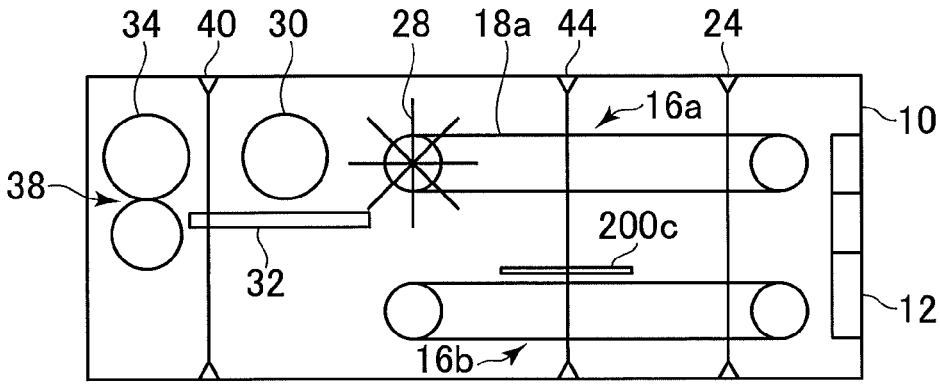

When the bills 200*b* are all separated to be sent out to the subsequent stage, the driving unit, not shown, is disabled to thereby stop the tongue pieces 28, the picker roller 30 and the feed roller 34 from rotating. The state at that time is shown in FIG. 15 where only the bills 200*c* remain in the lumped-media conveyer mechanism 16.

The reason that the bills 200*c* remain will be further described below. Because the lower conveyance channel 16*b* is brought down in advance of the start of the rotary movements of the picker roller 30 and the like, the bills 200*c* remain without being pressed against the upper conveyor 16*a*. That causes no friction between the endless belts 18*a* and the bills 200*c*. Moreover, since the bills 200*c* are outside the position where the tongue pieces 28 are available, they remain in the lumped-media conveyer mechanism 16 until the other bills 200*b* are completely fed out.

Figure 16:
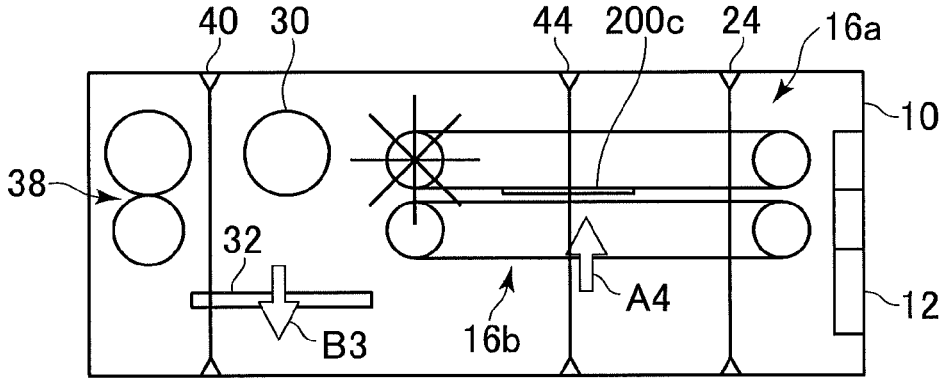

At this time, the sensors 44 are in the state capable of sensing the bills 200*c* remaining in the lumped-media conveyer mechanism 16. Then, in order to send out next the remaining bills 200*c* to the outside of the media separator 10, as shown in FIG. 16, the lower conveyor 16*b* of the lumped-media conveyer mechanism 16 is moved upward again by the driving unit, not shown, as depicted with an arrow A4, to pinch the bills 200*c* between the upper conveyor 16*a* and the lower conveyor 16*b*. As a result, if the lumped bills 200 originally include the bills 200*c* in plural, a new lump of bills 200*c* is formed. Further, the press 32 is moved downward again as shown by an arrow B3 by the driving unit, not shown.

Figure 17:
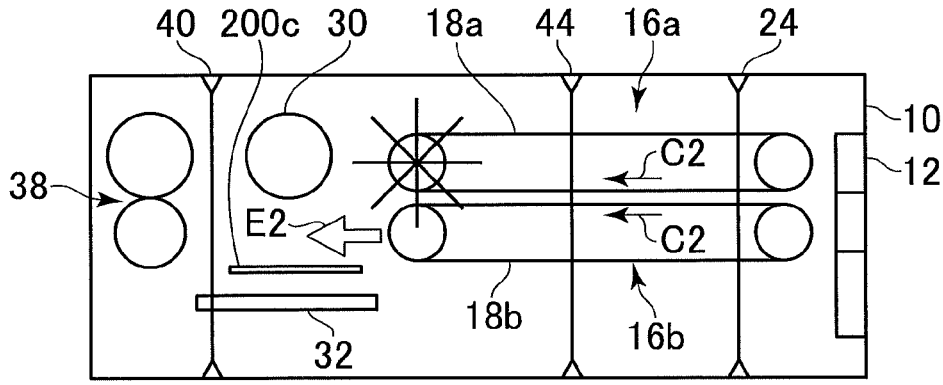

Subsequently, as shown in FIG. 17, the driving unit, not shown, is operated to rotate the pulleys 20 and 22, thereby operating the endless belts 18*a* and 18*b* mounted on the lumped-media conveyer mechanism 16 in the direction in which the bills 200*b* are conveyed, i.e. in the direction of an arrow C2. As a result, the lump of bills 200*c* is conveyed in the direction of an arrow E2, more specifically, toward the picker roller 30. That is also the case with the bill 200*c* being single.

When the sensors 40 senses the conveyed bills 200*c* having arrived at the vicinity short of the separator gate 38, the driving unit, not shown, is disabled after the predetermined period of time elapsing to thereby stop the endless belts 18. Thus, the bills 200*c* are sent by the predetermined distance, and thereafter stop from being conveyed. It is noted that, in the case where the length L3 of the bills 200*c* is so short as not to be conveyed to the sensable area of the sensors 40, the driving unit, not shown, is arranged to stop after running the endless belts 18 for a predetermined period of time. That will allow the bills 200*c* to be conveyed to the press 32 as shown in FIG. 17.

Figure 18:
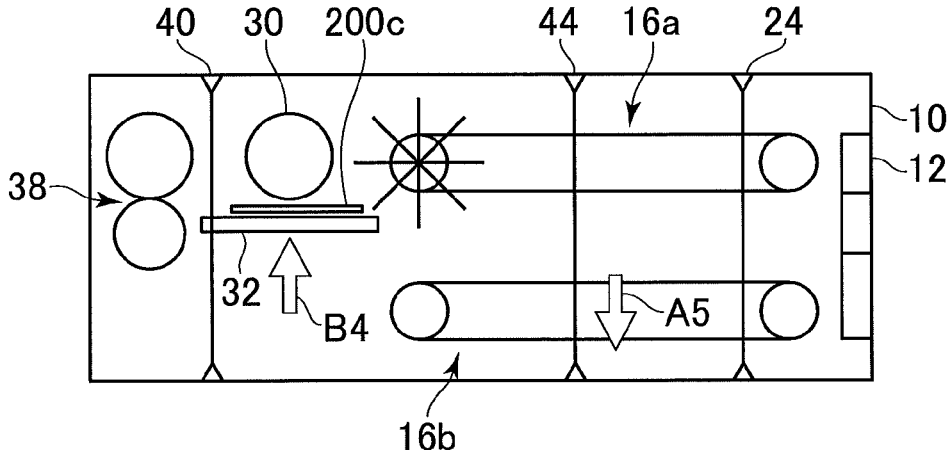

Next, as shown in FIG. 18, the press 32 is moved upward as an arrow B4 by the driving unit, not shown, to press the bills 200*c* against the picker roller 30. Further, the lower conveyor 16*b* is moved downward as an arrow A5 by the driving unit, not shown. The bills 200*c* are thereby pinched between the press 32 and the picker roller 30.

Figure 19:
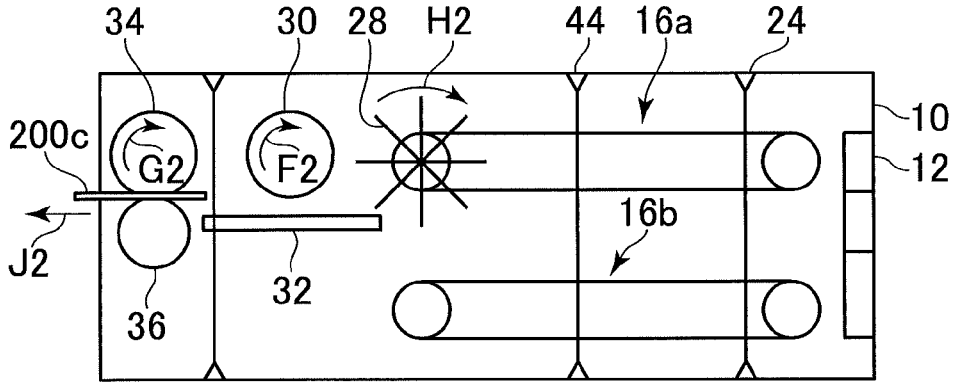

Next, as shown in FIG. 19, the driving unit, not shown, rotates the picker roller 30, the feed roller 34 and the tongue pieces 28 in the directions designated with arrows F2, G2 and H2, respectively. In turn, the bills 200*c* are conveyed by the picker roller 30 in the direction shown by an arrow J2, and pass between the feed roller 34 and the reverse roller 36 to be discharged one by one.

The above description of the operation is directed to the case where the bills 200*c* remaining inside the lumped-media conveyer mechanism 16 are detected by the remaining-media sensors 44 installed inside the media separator 10. However, regardless of whether to sense bills by the sensors 44, or to provide the sensors 44 per se, the operation shown in FIGS. 12 to 19 may be unconditionally performed after all the bills sensed by the gate sensors 40 have completely been separated and fed out.

In addition, when all the lumped bills 200 have the same longitudinal length, the media separator 10 still operates as described above and shown in FIGS. 12 to 19. In that case, all the bills are conveyed to the picker roller 30 without requiring auxiliary conveyance by the tongue pieces 28. Then, the bills are directly conveyed to the separator gate 38 to be individually fed out. When the bills are fed out one by one from the separator gate 38 and the remaining bills are pressed by the press 32 against the picker roller 30 in the vicinity of the separator gate 38, the tongue pieces 28 will idle above the stopped bills. This operation is done also in the case where the bills 200*a* and 200*b* have the front edges thereof, in the conveying direction of the bills 200, aligned, namely, the bills are inserted with the aligned edges thereof directed to the bill input slot 14.

In accordance with the alternative embodiment, when the bills 200*b* and 200*c* different in length are inserted in a lump without aligning the longitudinal leading edges thereof in the conveying direction and the shorter bills 200*c* do not reach the picker roller 30 and the tongue pieces 28 as auxiliary conveying bodies to remain in the lumped-media conveyer mechanism 16, the operation is performed of conveying only the bills 200*c* remaining, after having the bills 200*b* separated and fed out, again to the picker roller 30, thereby being able to separate even too short bills 200*c* individually from the lumped bills 200 to sent them one by one to the subsequent device.

Figure 20:
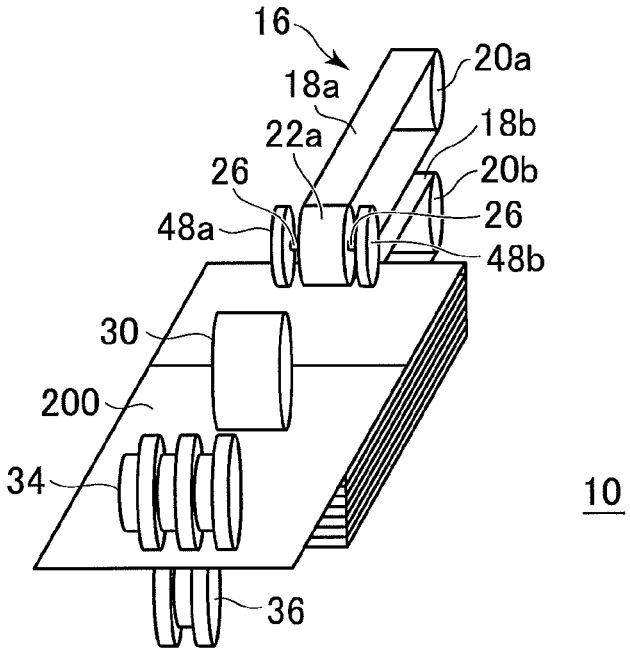
FIG. 20 is an essential perspective view schematically showing another alternative embodiment of the media separator according to the present invention.
Figure 21:
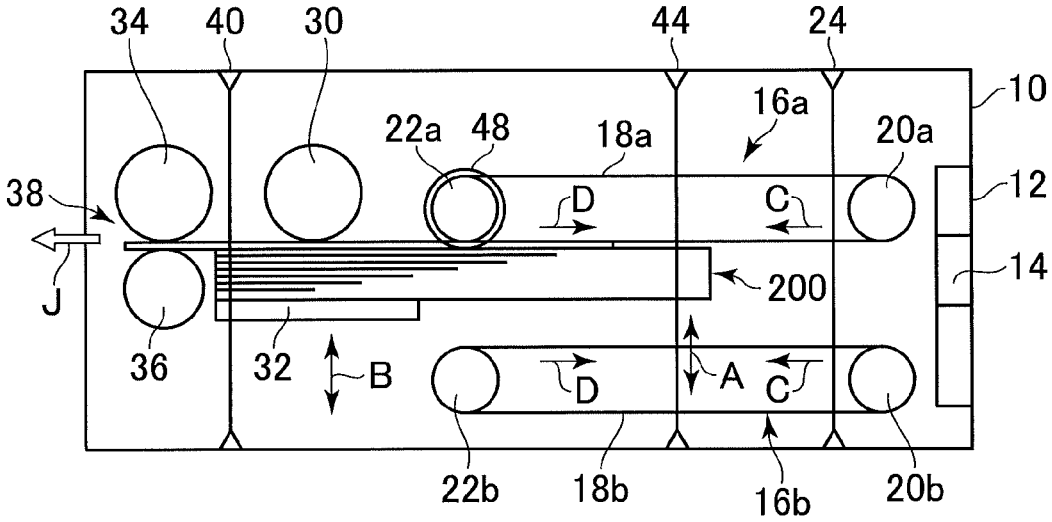
FIG. 21 is a schematic essential side view of the embodiment shown in FIG. 20.

Next, the configuration and operation of another alternative embodiment of the media separator 10 according to the present invention will be described with reference to FIGS. 20 and 21. Some of the components of the media separator 10 according to the instant alternative embodiment which are the same as in the above-described embodiments are denoted by the same reference numerals, and will not be described in detail. Further, for convenience of understanding the invention, some of the components may daringly be omitted from illustration.

As compared of the instant alternative embodiment with the above-described embodiments, there is a difference that the auxiliary conveying bodies fixed to the opposite ends of the shaft 26 penetrating the pulley 22*a* are the tongue pieces 28*a* and 28*b* in the above-described embodiments, whereas those are elastic rollers 48*a* and 48*b* in the present alternative embodiment. The elastic rollers 48 are discoid bodies made of elastic material such as rubber or plastic, which is easily deformable with external force. The rollers 48*a* and 48*b* have circular and planar central portions bonded to the ends of the shaft 26 so as to rotate while the shaft 26 rotates. By this rotary movement, the elastic rollers 48 feed out media such as bills, which are so short as not to reach the picker roller 30, toward the picker roller 30. Since the elastic rollers 48 are made of the elastic material, they can feed out the bills 200, being supplied, to the picker roller 30 without applying a great load to the bills 200.

The operation of the instant embodiment having the elastic rollers 48 as well will proceed in a way similar to the earlier-described embodiment having the tongue pieces 28 shown in FIGS. 4 to 10. Further, the operation in the case where the bills 200*c* which are so short as not to reach the elastic rollers 48 remain in the lumped-media conveyer mechanism 16 when the front edges of the longer bills 200*b* stop at the separator gate unit 38 will proceed in a way similar to the procedure shown in FIGS. 12 to 19, preferably by means of the remaining-media sensors 44. Therefore, detailed description of the operation of the present embodiment will be omitted.

With the media separator 10 in accordance with the present embodiment thus configured and operated, even when the bills 200 in which the bills different in length are mixed are inserted in a lump without aligning the longitudinal front edges, in the conveying direction, of the lumped bills 200, it is possible for the elastic rollers 48 to convey to the picker roller 30 the shorter bills 200*a* which have not reached the picker roller 30 when the conveyance of the bills 200 is stopped short of the separator gate 38. Further, even when the shorter bills 200 do not reach the elastic rollers 48 to remain in the lumped-media conveyer mechanism 16, it is possible to convey only the remaining bills 200*c*, after having separated and fed out the bills 200*b*, to the picker roller 30. It is thereby possible to separate the shorter bills 200*a* and 200*c* one by one from the lumped bills 200 to convey them to the subsequent device.

The entire disclosure of Japanese patent application No. 2008-180100 filed on Jul. 10, 2008, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

The invention claimed is:

1. A media separator for separating and sending out lumped media, comprising:

a lumped-media conveyer mechanism which receives the lumped media to convey the lumped media in a predetermined direction, the lumped-media conveyer mechanism including conveyors, including an upper conveyor and a lower conveyor, for conveying the lumped media while pinching the lumped media, said upper conveyor including a pulley arranged at a downstream end of the upper conveyor in a conveyance direction of said lumped media in said lumped-media conveyer mechanism, and an auxiliary conveyer body disposed coaxially with said pulley; and a picker roller which separates the lumped media conveyed by said lumped-media conveyer mechanism, wherein the auxiliary conveyer body is for assisting in separation of the lumped media by the picker roller by conveying one or more media of the lumped media to said picker roller.

2. The media separator according to claim 1, further comprising a press arranged vertically under and facing said picker roller for pressing the lumped media against said picker roller.

3. The media separator according to claim 2, wherein said press is moved vertically to press the lumped media against said picker roller and release the lumped media from said picker roller, said lower conveyor is moved vertically to pinch the lumped media with said upper conveyor and release the lumped media from said upper conveyor.

4. The media separator according to claim 2, further comprising at least one remaining-media sensor which detects remaining media of the lumped media remaining in said lumped-media conveyer mechanism, said lumped-media conveyer mechanism and said press being responsive to said at least one remaining-media sensor detecting the remaining media by being moved vertically.

5. The media separator according to claim 1, wherein said auxiliary conveyer body includes tongue pieces having plate-like bodies made of elastic material and radially disposed.

6. The media separator according to claim 5, wherein said tongue pieces are made of rubber.

7. The media separator according to claim 5, wherein said tongue pieces are made of synthetic resin.

8. The media separator according to claim 1, wherein said auxiliary conveyer body includes a roller made of elastic material.

9. The media separator according to claim 8, wherein said roller of the auxiliary conveyer body is made of rubber.

10. The media separator according to claim 8, wherein said roller of the auxiliary conveyer body is made of plastic.

11. The media separator according to claim 4, wherein when said at least one remaining-media sensor detects the remaining media, said lumped-media conveyor mechanism conveys the remaining media onto said press, said press is moved vertically to press the conveyed remaining media against said picker roller, and said picker roller rotates in a direction for discharging the remaining media from said media separator.

12. A media separating method for separating lumped media inserted into a media separator and sending out the separated media from the media separator, comprising:

conveying, with a lumped-media conveyer mechanism, the lumped media in a predetermined direction towards a picker roller;

separating, with the picker roller, ones of the conveyed lumped media from each other;

sending one or more of the separated ones of the lumped media out of the media separator;

after the step of sending, detecting whether a medium of the lumped media remains in the lumped-media conveyer mechanism with a remaining-media sensor that is positioned so as to detect a rear end of such a remaining medium; and when the remaining-media sensor detects a remaining medium in the lumped-media conveyer mechanism conveying, with the lumped-media conveyer mechanism, the remaining medium onto a press arranged vertically under and facing the picker roller, pressing the remaining medium against the picker roller by an upward movement of the press, and rotating the picker roller in a direction such that the pressed remaining medium is sent out of the media separator.

13. The media separating method of claim 12, wherein in the step of detecting, remaining media is detected, the remaining media including the remaining medium, further wherein in the step of conveying the remaining medium, the remaining media is conveyed, with the lumped-media conveyer mechanism, onto the press, further wherein in the step of pressing the remaining medium, the remaining media is pressed against the picker roller by the upward movement of the press, and further wherein in the step of rotating the picker roller in the direction such that the pressed remaining medium is sent out of the media separator, the remaining media is pressed against the picker roller such that remaining ones of the media are separated from each other and are separately sent out from the media separator.

14. A media separating method for separating lumped media inserted into a media separator and sending out the separated media from the media separator, comprising:

conveying, with a lumped-media conveyer mechanism, the lumped media in a predetermined direction towards a picker roller;

separating, with the picker roller, ones of the conveyed lumped media from each other;

sending one or more of the separated ones of the lumped media out of the media separator;

after the steps of sending and separating, detecting a remaining medium of the lumped media remaining in the lumped-media conveyer mechanism;

conveying, with the lumped-media conveyer mechanism, the remaining medium onto a press arranged vertically under and facing the picker roller;

pressing the remaining medium against the picker roller by an upward movement of the press; and rotating the picker roller in a direction such that the pressed remaining medium is sent out of the media separator.

15. The media separator according to claim 1, wherein the auxiliary conveyer body feeds toward the picker roller an uppermost medium of the lumped media.

16. The media separator according to claim 1, wherein the auxiliary conveyer body feeds toward the picker roller a medium of the lumped media that is pressed against the auxiliary conveyer body but not the picker roller.

17. The media separator according to claim 1, wherein a distance between the picker roller and the auxiliary conveyer body is shorter than a length of a medium of the lumped media.

18. The media separator according to claim 4, wherein the auxiliary conveyor body is positioned between the picker roller and the at least one remaining-media sensor.

* * * * *